US007931454B2

(12) United States Patent
Yamaguchi et al.

(10) Patent No.: US 7,931,454 B2
(45) Date of Patent: Apr. 26, 2011

(54) PUMP DEVICE

(75) Inventors: Takahiro Yamaguchi, Kariya (JP); Takashi Sato, Okazaki (JP); Takeshi Fuchida, Kariya (JP); Shigeki Torii, Anjo (JP); Hidemi Ikai, Kariya (JP); Hiroyuki Shinkai, Obu (JP)

(73) Assignee: Advics Co., Ltd., Aichi-pref. (JP)

( * ) Notice: Subject to any disclaimer, the term of this patent is extended or adjusted under 35 U.S.C. 154(b) by 1064 days.

(21) Appl. No.: 11/727,589

(22) Filed: Mar. 27, 2007

(65) Prior Publication Data

US 2007/0231177 A1 Oct. 4, 2007

(30) Foreign Application Priority Data

Apr. 3, 2006 (JP) ..... 2006-101949
Apr. 3, 2006 (JP) ..... 2006-101950

(51) Int. Cl.
*F03C 4/00* (2006.01)
*F04C 18/00* (2006.01)
*F04C 2/00* (2006.01)

(52) U.S. Cl. ..... 418/171; 418/166; 384/513; 384/490

(58) Field of Classification Search ..... 418/166, 418/171; 384/513, 490
See application file for complete search history.

(56) References Cited

U.S. PATENT DOCUMENTS

| | | | | |
|---|---|---|---|---|
| 2,637,605 | A * | 5/1953 | Powers | 384/482 |
| 3,214,224 | A * | 10/1965 | Lash | 384/517 |
| 4,492,539 | A * | 1/1985 | Specht | 418/171 |
| 4,971,525 | A * | 11/1990 | Nakayoshi et al. | 417/201 |
| 5,509,198 | A * | 4/1996 | Takamizawa et al. | 29/898.09 |
| 2007/0096550 | A1 * | 5/2007 | Yamaguchi et al. | 303/10 |

FOREIGN PATENT DOCUMENTS

JP A-2004-52988 2/2004

* cited by examiner

*Primary Examiner* — Theresa Trieu
(74) *Attorney, Agent, or Firm* — Posz Law Group, PLC

(57) ABSTRACT

A bearing is located with movement of an outer race in the longitudinal direction of a drive shaft being restricted, and the drive shaft is fixed to an inner race with the press fit, so that, it is possible to prevent the drive shaft from escaping. In addition, the inner race is longer than the outer race. Therefore, it is possible to obtain sufficient strength of the press fit of the drive shaft in the inner race while suppressing the size of the outer race (in other words, suppressing the size of the pump device). As a consequence, the size of the pump device can be suppressed while increasing reliability of the function for preventing the drive shaft from escaping.

6 Claims, 4 Drawing Sheets

PUMP DEVICE

CROSS REFERENCE TO RELATED APPLICATION

This application is based on and incorporates herein by reference Japanese patent applications No. 2006-101949 filed on Apr. 3, 2006 and No. 2006-101950 filed on Apr. 3, 2006.

FIELD OF THE INVENTION

The present invention relates to a pump device for drawing in and discharging fluid by driving a pump by using a drive shaft supported by a bearing.

BACKGROUND OF THE INVENTION

In Japanese Patent Publication Number 2004-52988, a conventional pump device including a case, a pump in the case, a drive shaft inserted in the case, and a bearing for supporting the drive shaft so that drive shaft can freely rotate. The conventional pump device draws in and discharges fluid by driving the pump by using the drive shaft.

The conventional pump device uses, as the bearing for supporting the drive shaft, a needle bearing which lacks an inner race and therefore cannot restrict movement of the drive shaft relative to the bearing. As a consequence, it is difficult to prevent the drive shaft from escaping by means of the bearing. In order to prevent the drive shaft from escaping, an end of the drive shaft is inserted into a ring-like member and the other end of the drive shaft is radially enlarged. Therefore, an additional member (the ring-like member) is required in order to prevent the drive shaft from escaping. In this case the drive shaft has to be sufficiently extended so as to accommodate the ring-like member.

SUMMARY OF THE INVENTION

It is therefore an object of the present invention to provide a pump device which prevents a drive shaft from escaping, suppress the number of elements required for the pump device, the length of the drive shaft, and accordingly the size of the pump device.

In an aspect of the present invention, a pump device includes: a first case; a drive shaft inserted in the first case; a first bearing for supporting the drive shaft allowing the drive shaft to rotate; and a first pump which is located in the first case and is driven by the drive shaft to draw in and discharge fluid. The first bearing includes: an inner race into which the drive shaft is inserted with a press fit; an outer race which is located in the first case with movement of the outer race in the longitudinal direction of the drive shaft restricted; and a rolling body which is inserted between the inner race and the outer race while having capability of restricting relative movement between the inner race and the outer race in the longitudinal direction of the drive shaft; and a length of the inner race in the longitudinal direction of the drive shaft is larger than a length of the outer race in the longitudinal direction of the drive shaft.

Thus, the bearing is located with the movement of the outer race in the longitudinal direction of the drive shaft being restricted, and the drive shaft is fixed to the inner race with the press fit. Therefore, the movement of the drive shaft in its longitudinal direction is restricted by the bearing. In other words, it is possible to prevent the drive shaft from escaping.

In addition, the inner race is longer than the outer race. Therefore, it is possible to obtain sufficient strength of the press fit of the drive shaft in the inner race while suppressing the size of the outer race (in other words, suppressing the size of the pump device). As a consequence, the size of the pump device can be reduced while increasing reliability of the function for preventing the drive shaft from escaping.

The outer race is located in order to prevent the drive shaft from moving toward any side along its longitudinal direction. Therefore, it is not necessary to have a radially enlarged portion which a conventional pump device includes as described before has to have. As a consequence, the drive shaft can be made to have a simple shape.

In the pump device, the outer race may be inserted into the first case with a loose fit and may be restricted in its movement in the longitudinal direction of the drive shaft caused by a surface of the first case, the surface facing the longitudinal direction of the drive shaft and being in touch with the outer race.

In this case, it is possible to restrict the movement of the outer race in the longitudinal direction of the drive shaft without inserting the outer race into the first case with a press fit. Therefore, it is possible to suppress deformation of the first case.

The pump device may include a plurality of bearings for supporting the drive shaft allowing the drive shaft to rotate, the plurality of bearings including the first bearing. In this case, each of one or more of the plurality of bearings may include: a first inner race into which the drive shaft is inserted with a press fit; a first outer race which is located in the first case with movement of the first outer race in the longitudinal direction of the drive shaft restricted and is larger than the first inner race in length in the longitudinal direction of the drive shaft; and a first rolling body which is inserted between the first inner race and the first outer race while having capability of restricting relative movement between the first inner race and the first outer race in the longitudinal direction of the drive shaft. In addition, each of the other one or more of the plurality of bearings may include a second inner race; and a second outer race which is as large as the second inner race in length in the longitudinal direction of the drive shaft.

In this case, the other one or more of the plurality of bearings can be made to be smaller than the one or more of the plurality of bearings in length in the longitudinal direction of the drive shaft. This allows the pump device to be downsized. It is also possible to use a general-purpose bearing for the other one or more of the plurality of bearings. As a consequence manufacturing cost of the pump body can be suppressed.

In this case, in each of the one ore more of the bearings, the first inner race is still larger than the first outer race in length in the longitudinal direction of the drive shaft. Therefore, a sufficient strength of the press fit of the drive shaft is maintained. As a consequence the drive shaft is well restricted in the longitudinal direction of the drive shaft.

The pump device may include a plurality of bearings for supporting the drive shaft allowing the drive shaft to rotate, the plurality of bearings including the first bearing. In this case, each of one or more of the plurality of bearings may include: a first inner race into which the drive shaft is inserted with a press fit; a first outer race which is located in the first case with movement of the first outer race in the longitudinal direction of the drive shaft restricted and is larger than the first inner race in length in the longitudinal direction of the drive shaft; and a first rolling body which is inserted between the first inner race and the first outer race while having capability of restricting relative movement between the first inner race and the first outer race in the longitudinal direction of the drive shaft. In addition, each of the other one or more of the plurality of bearings may include a second inner race into which the drive shaft is inserted with a loose fit.

In this case, the other one or more of the plurality of bearings can be installed to the drive shaft in a simple manner. Therefore, improved easy installation of the pump device is achieved.

The pump device may include: a housing including a concave portion; a second case which is located coaxially with the first case and is movable relative to the first case in the longitudinal direction of the drive shaft; and a spring means which is located between the first case and the second case and biases the first case and second case so that the first case and second case get apart from each other. In this case, the first case and the second case may be inserted into the concave portion in a manner that the first case is closer to the bottom of the concave portion than the second case is. The second case may be pressed against the first case in a direction from the entrance of the concave portion to the first case. The outer race may be in touch with a surface of the first case, the surface facing a bottom surface of the concave portion and may be in touch with the bottom surface of the concave portion, so that movement of the outer race is restricted in the longitudinal direction of the drive shaft.

An interval between the first case and the second case easily changes because the spring means is inserted between the first case and the second case. A range within which the outer race can move in the longitudinal direction of the drive shaft would easily change accordingly if the outer race were in touch with the first case and the second case in order to restrict the movement of the outer race in the longitudinal direction of the drive shaft. In contrast, the change of the interval hardly cause such harmful effect when the outer race is located between the surface of the first case defined above and the bottom of the concave portion, as described above. Therefore, it is possible to reduce the range within which the outer race can move in the longitudinal direction of the drive shaft. As a consequence, it is possible to reduce a range within which the drive shaft can move in the longitudinal direction of the drive shaft.

The first pump may be a gear pump and at least one of the plurality of bearings is a ball bearing. Thus, the drive shaft can be fixed into the inner race of the ball bearing with a press fit in order to restrict the drive shaft in its movement in the longitudinal direction of the drive shaft. Therefore, the ball bearing contributes to preventing the drive shaft from escaping. As a consequence, an additional member for preventing the drive shaft from escaping is not necessary, which suppresses number of elements for composing the pump device and makes it possible to shorten the drive shaft.

The pump device may include a second pump which is installed in the first case, is driven by the drive shaft to draw in and discharge fluid, and is aligned with the first pump in the longitudinal direction of the drive shaft. In this instance, the first case may include: a middle cylinder which is located between the first pump and the second pump and is faced by a surface of the first pump and a surface of the second pump; a first side cylinder which is located at the opposite side of the first pump from the middle cylinder and is faced by the other surface of the first pump; and a second side cylinder which is located at the opposite side of the second pump from the middle cylinder and is faced by the other surface of the second pump. In addition, annular grooves may be formed respectively on surfaces of the middle cylinder, the surfaces facing respectively the first pump and the second pump. Moreover, a first seal member sealing a space between the first pump and the middle cylinder may be located within one of the annular grooves. Furthermore, a second seal member sealing a space between the second pump and the middle cylinder may be located within another one of the annular grooves.

Thus, the spaces between the pumps and the middle cylinder are sealed by the seal members. Therefore, it is not necessary to slide the pumps on the middle cylinder with a friction. It is not therefore necessary to compose the middle cylinder with material of high hardness such as high-carbon steel or to harden the surface of the middle cylinder facing the pumps. Therefore, the middle cylinder can be made in a simple manner, and the manufacturing cost of the middle cylinder can be reduced.

The first pump and the first side cylinder may be in touch with each other so that a space between the first pump and the first side cylinder is sealed. In this instance, the second pump and the second side cylinder may be in touch with each other so that a space between the second pump and the second side cylinder is sealed.

In this instance, it is not necessary to form an annular groove on the side cylinders to accommodate a seal member. Needlessness of forming the annular groove is especially profitable in the case that the side cylinders are made of material of high hardness such as,the high-carbon steel.

The middle cylinder may include a center hole into which the drive shaft is inserted. In this case, an axis seal member may be located at the center hole and seal a space between the middle cylinder and the drive shaft. In addition, one of the annular grooves may be located radially outside of the axis seal member.

In this case, the length of the middle cylinder in the longitudinal direction of the drive shaft can be smaller than in the case that the axis seal member and the annular groove are aligned along the longitudinal direction of the drive shaft. Therefore, the size of the pump device can be reduced.

BRIEF DESCRIPTION OF THE DRAWINGS

The invention, together with additional objective, features and advantages thereof, will be best understood from the following description, the appended claims and the accompanying drawings. In the drawings:

DETAILED DESCRIPTION OF THE EMBODIMENTS

A vehicle brake device using a pump device according to an embodiment of the present invention will be described below with reference to FIG. 1. An internal pump (specifically, a trochoid pump) is used as a rotary pump of the brake device shown in FIG. 1. In the following description, the brake device is applied to a front-wheel-drive four-wheel vehicle having an X type hydraulic circuit which includes a first conduit system for both the front right wheel and the rear left wheel, and a second conduit system for both the front left wheel and the rear right wheel. However, the brake device may also be applied to a vehicle having a front-rear type hydraulic circuit which includes a conduit system for both the front right wheel and the front left wheel and another conduit system for both the rear right wheel and the rear left wheel and to a vehicle having any other type of hydraulic circuit.

Figure 1:
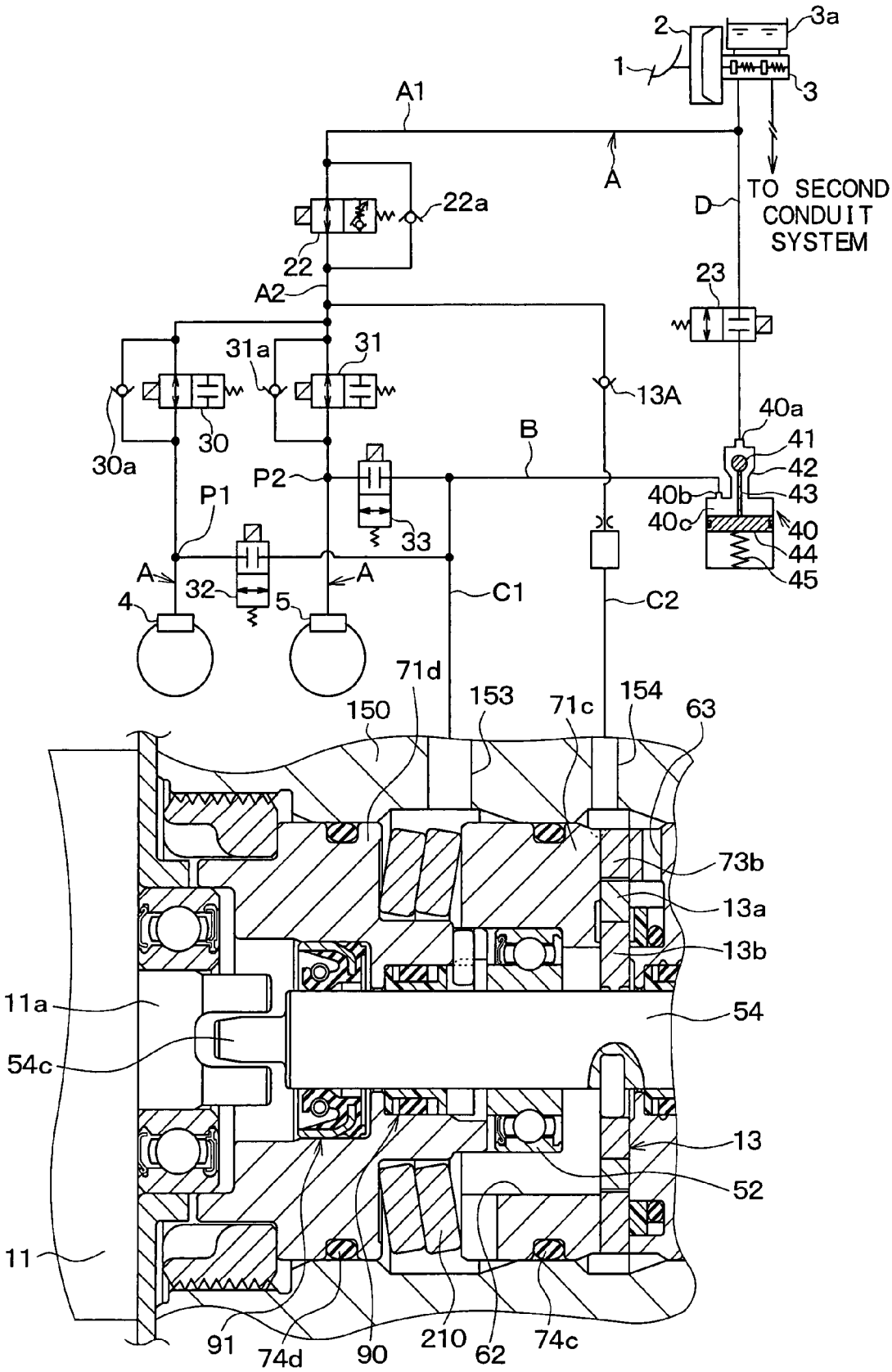
FIG. 1 is a schematic diagram showing a vehicle brake device having a pump device according to an embodiment of the present invention.

As shown in FIG. 1, a brake pedal 1 is connected with a booster 2, which amplifies a brake pedaling force and the like.

The booster 2 includes a push rod which transmits the amplified pedaling force to a master cylinder 3. The push rod presses a master piston located in the master cylinder 3 to generate a master cylinder pressure. The brake pedal 1, the booster 2, and the master cylinder 3 correspond to an example of a brake hydraulic pressure generating means.

Connected with the master cylinder 3 is a master reservoir 3*a*, which provides the master cylinder 3 with brake fluid and collects excessive brake fluid in the master cylinder 3.

The master cylinder pressure is transmitted to a wheel cylinder 4 for the front right wheel and a wheel cylinder 5 for the rear left wheel, via an actuator for controlling a brake hydraulic pressure which performs ABS control or the like. Although the following description is concerned with the first conduit system for the front right wheel and the rear left wheel, it can be fully applied to the second conduit system for the front left wheel and the rear right wheel.

The brake device includes a main conduit A which is connected with the master cylinder 3. A linear differential pressure control valve 22 and a check valve 22*a* are located in the conduit A. The valve 22 divides the conduit A into two regions, namely, a conduit A1 and a conduit A2. The conduit A1 spans a path between the master cylinder 3 and the valve 22 and receives the master cylinder pressure. The conduit A2 spans a path between the valve 22 and the wheel cylinder 4 and a path between the valve 22 and the wheel cylinder 5.

In normal operation of the brake device, the valve 22 is set to a communicative state in which the brake hydraulic pressure is fully transmitted through the valve 22. The valve 22 is set to a differential pressure state when sudden braking is applied to the wheel cylinders 4 and 5 after the master cylinder pressure falls below a predetermined pressure, and when traction control is performed. In the differential pressure state, a predetermined difference in the brake hydraulic pressure is generated between the master cylinder side and the wheel cylinder side of the valve 22. The predetermined pressure difference for the valve 22 is linearly adjustable.

The conduit A2 branches into two paths. A first pressure increase control valve 30 is located in one of the paths and controls the brake hydraulic pressure applied to the wheel cylinder 4. A second pressure increase control valve 31 is located in the other one of the paths and controls the brake hydraulic pressure applied to the wheel cylinder 5.

The valves 30 and 31 are constructed as two-position valves each of which switches between a communicative state and a closed state based on control of an electronic control unit (hereinafter referred to as an ECU). When one of these two-position valves 30 and 31 is set to the communicative state, the master cylinder pressure (or the brake hydraulic pressure which is generated by discharged fluid from the rotary pump) can be applied to the corresponding one of the wheel cylinders 4 and 5. When one of these two-position valves 30 and 31 is set to the closed state, transmission of pressure between fluids at both sides of the one two-position valve is prohibited. The first and second pressure-increasing control valves 30 and 31 are normally set to the communicative states during normal braking operation in which ABS control is not being performed.

Safety valves 30*a* and 31*a* are located in parallel with the control valves 30 and 31, respectively. The safety valves 30*a* and 31*a* remove the brake fluid from the wheel cylinders 4 and 5, respectively, when the brake pedal 1 becomes no longer depressed and the ABS control becomes no longer performed.

A reservoir 40 is connected through an intake conduit B with a first point P1 in the conduit A between the valve 30 and the wheel cylinder 4, and with a second point P2 in the conduit A between the valve 31 and the wheel cylinder 5. In the conduit B, a pressure decrease control valve 32 is located between the reservoir 40 and the first point P1, and another pressure decrease control valve 33 is located between the reservoir 40 and the second point P2. Each of the valves 32 and 33 switches between a communicative state and a closed state based on control of the ECU. Specifically, the valves 32 and 33 are always in the closed states during the normal braking operation in which the ABS control is not performed.

A third point located in the conduit A2 is connected with a rotary pump 13 through a conduit C1. The rotary pump 13 is connected through a conduit C2 and a part of the conduit B with the reservoir 40. Thus, the rotary pump 13 is located in a fluid path between the point P3 and the reservoir 40. A safety valve 13A is located in the conduit C1, in other words, at the delivery port side of the rotary pump 13, so as to keep the brake fluid from flowing backward. The rotary pump 13 is also connected with a motor 11 for driving the rotary pump 13. The second conduit system includes a rotary pump 10 (see FIG. 2) which has a structure identical to the rotary pump 13. The rotary pumps 10 and 13 will be described later in detail.

The reservoir 40 is connected with the master cylinder 3 through an auxiliary conduit D. A two-position valve 23 is disposed in the conduit D. The two-position valve 23 is set to the closed state so as to close the conduit D in the normal operation of the brake device. The two-position valve 23 is set to the communicative state and the conduit D attains the communicative state when brake assist, traction control and the like are performed. In the communicative state, the rotary pump 13 draws the brake fluid from the conduit A1 through the conduit D and discharges the brake fluid to the conduit A2. Accordingly, the wheel cylinder pressures for the wheel cylinders 4 and 5 become higher than the master cylinder pressure, thereby increasing a vehicle wheel braking force. In this case, the valve 22 maintains the pressure difference between the master cylinder pressure and the wheel cylinder pressure.

The reservoir 40 includes reservoir mouths 40*a* and 40*b*. The reservoir mouth 40*a* is connected with the conduit D and receives brake fluid from the master cylinder 3. The reservoir mouth 40*b* is connected with the conduit B and receives brake fluid escaping from the wheel cylinders 4 and 5. A ball valve 41 is located deeper in the reservoir 40 than the reservoir mouth 40*a* is. A rod 43 is separatably attached to the ball valve 41 and has a predetermined stroke for moving the ball valve 41 up and down.

In a reservoir chamber 40*c*, a piston 44 is located which moves in conjunction with the rod 43. In the reservoir chamber 40, a spring 45 is also located which generates a force to press the piston 44 toward the ball valve 41 and thereby push the brake fluid out of the reservoir chamber 40*c*.

When the reservoir 40 collects a predetermined amount of the brake fluid, the ball valve 41 comes to sit on a valve seat 42 and thereby prohibits the brake fluid from flowing into the reservoir 40. Therefore, the brake fluid does not flow into the reservoir chamber 40*c* beyond intake capacity of the rotary pump 13. Consequently, a high pressure is not applied to the intake side of the rotary pump 13.

Figure 2:
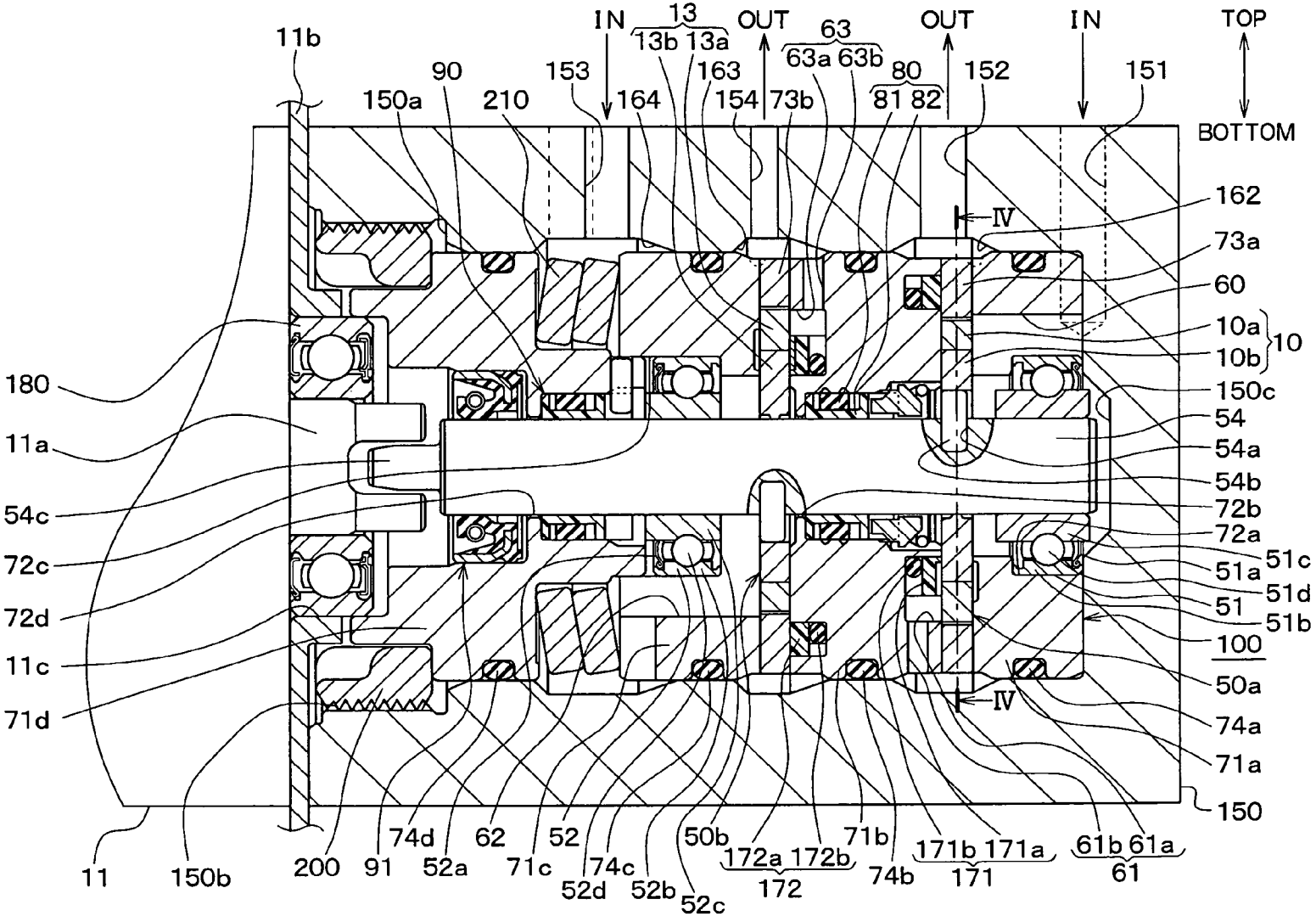
FIG. 2 is a cross-sectional view of the pump device including two rotary pumps.

In FIG. 2, the pump device 100 is attached to a housing 150 of the actuator for controlling the brake hydraulic pressure such that the vertical direction of the figure corresponds to the vertical direction of the vehicle. The overall configuration of the pump device 100 will be described below with reference to FIG. 2.

As explained above, the brake device includes two systems, namely, the first conduit system and the second conduit system. The pump body 100 includes the rotary pump 13 for the first conduit system shown in FIGS. 1 and 2 and the rotary pump 10 for the second conduit system shown in FIG. 2. The rotary pumps 10 and 13 are driven by a drive shaft 54.

A casing that forms the contour of the pump body 100 includes cylinders and cylindrical center plates. The cylinders include a first cylinder 71*a*, a second cylinder 71*b*, a third cylinder 71*c*, and a fourth cylinder 71*d*. The center plates include a first center plate 73*a* and a second center plate 73*b*. In the present embodiment, the first cylinder 71*a* serves as an example of a first side cylinder, the second cylinder 71*b* serves as an example of a middle cylinder, and the third cylinder 71*c* serves as an example of a second side cylinder.

The first cylinder 71*a*, the first center plate 73*a*, the second cylinder 71*b*, the second center plate 73*b*, and the third cylinder 71*c* are aligned in this order and each neighboring pair of them are joined by welding at outer peripheries of two facing surfaces of the pair. These welded members 71*a*, 73*a*, 71*b*, 73*b*, and 71*c* form a unit that serves as a first case. A disc spring 210 which serves as a spring is inserted between the third cylinder 71*c* of the first case and the fourth cylinder 71*d* which serves as a second case. The fourth cylinder 71*d* is disposed coaxially with the first case. Thus, an integral structure of the pump body 100 is achieved.

The pump body 100 with the integral structure described above is inserted into a substantially cylindrical concave portion 150*a* which is formed on the housing 150 of the actuator for controlling the brake hydraulic pressure.

A ring-shaped external thread member 200 is screwed into an internal thread 150*b* formed at the entrance of the concave portion 150*a*, whereby the pump body 100 is fixed to the housing 150. More specifically, a second concave portion 150*c* with a circular shape is formed at an area in the concave portion 150*a* of the housing 150. The area faces an end of the drive shaft 54 which is a part of the leading end of the pump body 100 in its inserting direction. The diameter of the second concave portion 150*c* is larger than that of the drive shaft 54, but smaller than the outer diameter of the first cylinder 71*a*. An end portion of the drive shaft 54, namely, a portion projecting toward the second concave portion from an end surface of the first cylinder 71*a*, is set in the second concave portion 150*c*, while a portion other than the second concave portion 150*c* at the bottom of the concave portion 150*a* comes in touch with an end face of the first cylinder 71*a*. The pump body 100 thus receives an axial force when the external thread member 200 is screwed into the internal thread 150*b*.

In a structure for fixing the pump body 100 to the concave portion 150*a* of the housing 150, the disc spring 210 operates as follows.

A strong axial force must be generated in order to fix the pump body 100 to the housing 150, in other words, in order to keep the pump body 100 from wobbling in the housing 150 due to a high brake hydraulic pressure which is generated when the pump body 100 intakes and discharges the brake fluid.

However, obtaining the above axial force solely by screwing of the external thread member 200 generates considerable variations in the axial force.

To resolve this issue, in the present embodiment, the disc spring 210 is located between the third and fourth cylinders 71*c* and 71*d*. The diameter of an end portion of the fourth cylinder 71*d* facing the third cylinder 71*c* is reduced compared to the other portions of the fourth cylinder 71*d*. This end portion is then inserted into a third center hole (or mouth) 72*c* of the third cylinder 71*c*. The diameter of this end portion of the cylinder 71*d* inserted into the third center hole 72*c* is set substantially similar to or slightly smaller than the diameter of the third center hole 72*c*. Thus, a part of the fourth cylinder 71*d* loosely fits in the third center hole 72*c* of the third cylinder 71*c*.

When the external thread member 200 is screwed into the internal thread 150*b*, an elastic force of the disc spring 210 between the fourth cylinder 71*d* and the third cylinder 71*c* becomes an axial force sufficient for fixing the pump body 100 to the concave portion 150*a* of the housing 150. In other words, the axial force is generated as follows. The disc spring 210 presses members located to the right of the third cylinder 71*c* in FIG. 2 against the bottom surface of the concave portion 150*a*. The disc spring 210 also presses the fourth cylinder 71*d* toward the external thread member 200. As a consequence, the axial force acting on the pump is stabilized and suppressed to the required minimum. Deformation of the pump body 100 can therefore be suppressed.

The disc spring 210 is configured such that a bottom face side thereof (a side on which a load acts on an outer peripheral portion thereof) faces the rotary pumps 10 and 13, and a top face side thereof (a side on which a load acts on an inner peripheral portion thereof) faces the motor 11.

The first to fourth cylinders 71*a* to 71*d* include first, second, third, and fourth center holes (or mouths) 72*a*, 72*b*, 72*c*, and 72*d*, respectively.

A bearing 51 is installed to the inner periphery of the first center hole 72*a* formed on the first cylinder 71*a*. Another bearing 52 is installed to the inner periphery of the third center hole 72*c* formed on the third cylinder 71*c*. The bearings 51 and 52 include ball bearings which have lengths in the longitudinal direction (that is, the axial direction) of the drive shaft 45, the lengths shorter than those of needle bearings.

More specifically, a bearing 51 is installed to the first center hole 72*a* in a manner that an outer race 51*b* having a cylindrical shape is inserted with a loose fit to a recessed part of the first center hole 72*a*. The recessed part is recessed radially outward and accordingly forms a stepped shape on the first center hole 72*a*. Both ends of the outer race 51*b* in the longitudinal direction of the drive shaft 54 face the edge of the stepped shape and the bottom of the concave portion 150*a* of the housing 150, respectively. Movement of the outer race 51*b* in the longitudinal direction of the drive shaft 54 is restricted because the outer race 51*b* is in touch with the edge of the stepped shape and the bottom of the concave portion 150*a* of the housing 150.

The drive shaft 54 is inserted with a press fit into a cylindrical inner race 51*c* of the bearing 51. The length of the inner race 51*c* in the longitudinal direction of the drive shaft 54 is larger than that of the outer race 51*b*, so that the inner race 51*c* holds the drive shaft 54 with a sufficiently strong force.

A large number of balls 51*d* serving as an example of a rolling body are inserted between the inner race 51*c* and the outer race 51*b*, so that relative movement between the inner race 51*c* and outer race 51*b* in the longitudinal direction of the drive shaft 54 is restricted.

Thus, the bearing 51 is located with the movement of the outer race 51*b* in the longitudinal direction of the drive shaft 54 being restricted, and the drive shaft is fixed to the inner race 51*c* with the press fit. Therefore, the movement of the drive shaft 54 in its longitudinal direction is restricted by the bearing 51. In other words, it is possible to prevent the drive shaft 54 from getting apart from the first cylinder 71*a*.

A bearing 52 installed to the third center hole 72*c* in a manner that an outer race 52*b* having a cylindrical shape is inserted with a loose fit to a recessed part of the third center hole 72*c*. The recessed part is recessed radially outward and accordingly forms a stepped shape on the third center hole 72*c*. Both ends of the outer race 52*b* in the longitudinal direction of the drive shaft 54 face the edge of the stepped shape and the third cylinder 71*c* side end of the fourth cylinder 71*d*, respectively.

The drive shaft 54 is inserted with a loose fit into a cylindrical inner race 52*c* of the bearing 52. Therefore, the bearing 52 can be easily installed to the drive shaft 54. The length of the inner race 52*c* in the longitudinal direction of the drive shaft 54 is as large as that of the outer race 52*b*.

A large number of balls 52*d* serving as an example of a rolling body are inserted between the inner race 52*c* and the outer race 52*b*, so that relative movement between the inner race 52*c* and outer race 52*b* in the longitudinal direction of the drive shaft 54 is restricted.

The bearings 51 and 52 have seal plates 51*a* and 52*a*, respectively. The seal plate 51*a* is positioned at an end of the bearing 51 closer to the head (i.e. the leading end of the insertion direction) of the drive shaft 54. The seal plate 52*a* is positioned at an end of the bearing 52 facing the fourth cylinder 71*d*.

Figure 3A:
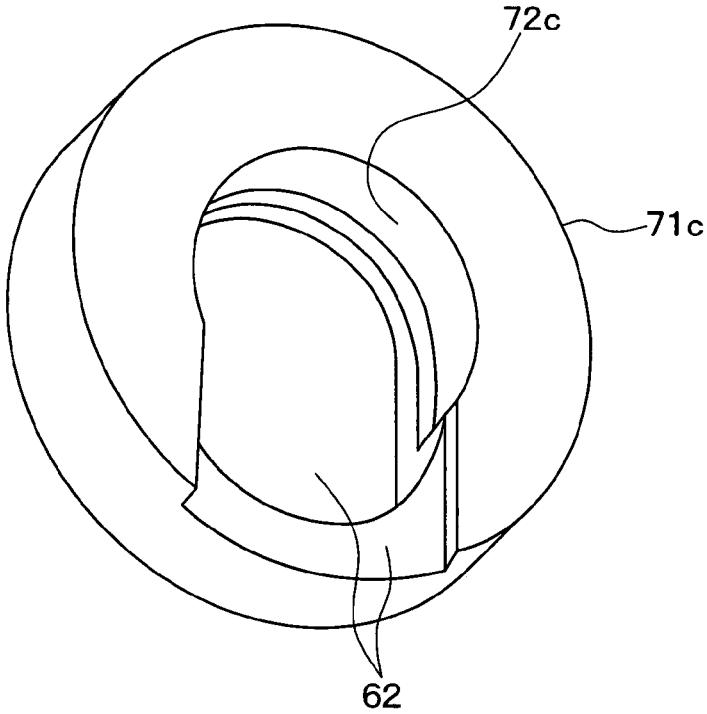
FIG. 3A is a perspective view of a third cylinder.
Figure 3B:
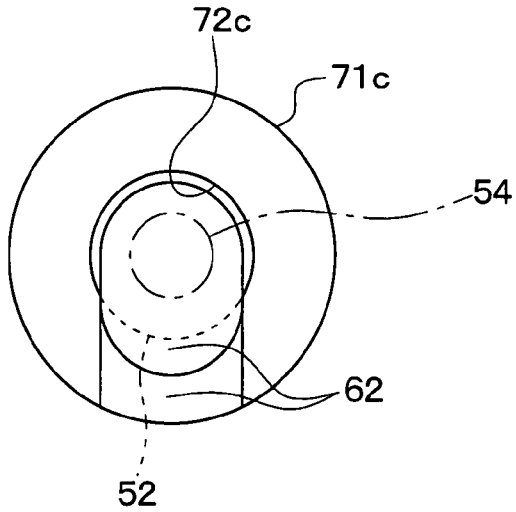
FIG. 3B is a frontal view of the third cylinder.

FIGS. 3A and 3B are close-up views of the third cylinder 71*c*. More specifically, FIG. 3A is a perspective view of the third cylinder 71*c*, and FIG. 3B is a schematic frontal view of the third cylinder 71*c* as seen from the direction parallel to the axis of the pump body 100. The third cylinder 71*c* has a groove within which an O-ring 74 described later is located. However, the O-ring 74 is not shown in FIGS. 3A and 3B.

As shown in FIGS. 3A and 3B, the third center hole 72*c* has a portion whose inner diameter is equal to the outer diameter of the bearing 52 and another portion whose diameter is smaller than the outer diameter of the bearing 52. These portions form a stepped portion. When the bearing 52 is pushed to meet the stepped portion, the bearing 52 fits in the inner side of the third center hole 72*c* and a cavity remains on the fourth cylinder 71*d* side of the third center hole 72*c*. A portion of the fourth cylinder 71*d* is inserted in this cavity.

The drive shaft 54 is inserted through the first to fourth center holes 72*a* to 72*d*, and is axially supported by the bearings 51 and 52. Each of the first to fourth center holes 72*a* to 72*d* serves as an example of a shaft insertion hole. Thus, the bearings 51 and 52 are disposed so that the rotary pumps 10 and 13 are arranged between them.

The third cylinder 71*c* also forms an intake port 62, which will be described later in detail.

Figure 4:
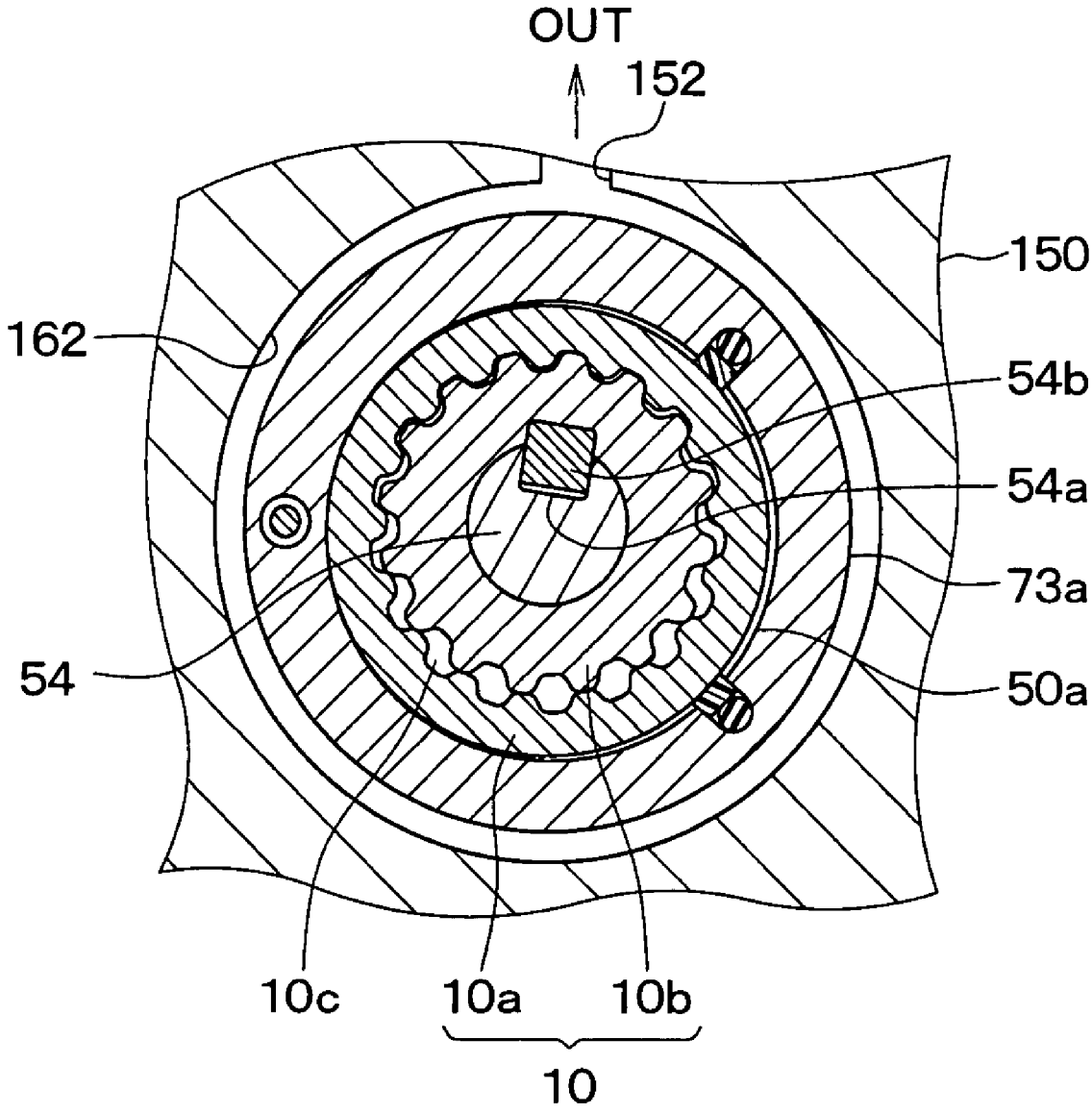
FIG. 4 is a cross-sectional view taken along the IV-IV line in FIG. 2.

FIG. 4 is a cross-sectional view taken along the line IV-IV in FIG. 2. Hereinafter, the structure of the rotary pumps 10 and 13 will be described with reference to FIGS. 2 and 4.

A rotor chamber 50*a* is formed by locating the cylindrical first center plate 73*a* between the first cylinder 71*a* and the second cylinder 71*b*. The rotary pump 10, which serves as an example of a first pump, is disposed within the rotor chamber 50*a*, and is configured as an internal gear pump (a trochoid pump) that is driven by the drive shaft 54.

More specifically, the rotary pump 10 includes a rotating portion having an outer rotor 10*a* and an inner rotor 10*b*. An internal teeth portion is formed on the inner periphery of the outer rotor 10*a*. An external teeth portion is formed on the outer periphery of the inner rotor 10*b*. The drive shaft 54 is inserted through a hole in the inner rotor 10*b*. A key 54*b* fits in an oval hole 54*a* (see FIG. 2) formed on the drive shaft 54. Torque is transmitted from the drive shaft 54 to the inner rotor 10*b* through the key 54*b*.

The internal teeth portion and the external teeth portion, which are formed on the outer rotor 10*a* and the inner rotor 10*b*, respectively, mesh to form a plurality of gap portions 10*c*. The rotary pump 10 draws in and discharges the brake fluid as the sizes of the gap portions 10*c* vary in accordance with rotation of the drive shaft 54.

A rotor chamber 50*b* is formed by locating the cylindrical second center plate 73*b* between the second cylinder 71*b* and the third cylinder 71*c*. The rotary pump 13, which serves as an example of a first pump, is disposed within the rotor chamber 50*b*. As well as the rotary pump 10, the rotary pump 13 is configured as an internal gear pump having an outer rotor 13*a* and an inner rotor 13*b*. The rotary pump 13 is disposed so as to rotate 180 degrees around the drive shaft 54 relative to the rotary pump 10. With such an arrangement, some of the gap portions 10*c* on the intake side of the rotary pump 10 and some of gap portions on the intake side of the rotary pump 13 are located symmetrically with respect to the drive shaft 54. Likewise, some of the gap portions 10*c* on the discharge side of the rotary pump 10 and some of gap portions on the discharge side of the rotary pump 13 are located symmetrically with respect to the drive shaft 54. Therefore, forces acting on the drive shaft 54 caused by the high brake hydraulic pressure on the discharge sides are canceled by each other.

The first cylinder 71*a*, which serves as an example of a first side cylinder, faces an end surface of the rotary pump 10. The first cylinder 71*a* and the rotary pump 10 are in touch with each other so that a space between the first cylinder 71*a* and the rotary pump 10 is sealed. The first cylinder 71*a* is made of high-carbon steel so that it has sufficient durability against friction caused by sliding of the rotary pump 10.

The first cylinder 71*a* includes an intake port 60 which is in communication with some of the gap portions 10*c* on the intake side of the rotary pump 10. The intake port 60 is formed so as to run from an end surface on the rotary pump 10 side of the first cylinder 71*a* to the opposite end surface of the first cylinder 71*a*. Therefore, the brake fluid is introduced from the opposite end face.

The intake port 60 is also connected with an intake passage 151, which is formed in the housing 150 so as to run from an outer surface of the housing 150 to the bottom face of the concave portion 150*a*.

The second cylinder 71*b*, which serves as an example of a middle cylinder, is located between the two rotary pumps 10 and 13 and faces the two rotary pumps 10 and 13.

The second cylinder 71*b* includes a discharge port 61 which is in communication with some of the gap portions 10*c* on the discharge side of the rotary pump 10. The discharge port 61 extends from a rotary pump 10 side of the second cylinder 71*b* to an outer periphery of the second cylinder 71*b*. More specifically, the discharge port 61 has a structure as described below.

The rotary pump 10 side of the second cylinder 71*b* (that is, an end surface of the second cylinder 71*b* facing the rotary pump 10) has an annular groove 61*a*, which is formed so as to surround the drive shaft 54. The annular groove 61*a* is formed solely by deformation processing such as forging.

A ring-shaped seal member 171 is located within the annular groove 61*a*. The seal member 171 includes a resin member 171*a* and a rubber member 171*b*. The resin member 171*a* is located closer to the rotary pump 10 than the rubber member 171*b* is. The rubber member 171*b* presses the resin member 171*a* toward the rotating member. The seal member 171 seals space between the rotary pump 10 and the second cylinder 71*b*. More specifically, the seal member is arranged so that a region within the ring shape of the seal member 171 includes some of the gap portions 10*c* at the intake side and a clearance between the first center plate 73*a* and a part of the outer periphery of the outer rotor 10*a*, the part corresponding to some of the gap portions 10*c* on the intake side. The seal member 171 is also arranged so that another region out of the ring shape of the seal member 171 includes some the gap portions 10*c* on the discharge side and a clearance between the first center plate 73*a* and a part of the outer periphery of the outer rotor 10*a*, the part corresponding to the gap portions 10*c* on the discharge side. Thus, relatively low-pressure region and a relatively high-pressure region on the inner and outer peripheries of the seal member 171 are separated from each other and sealed by the seal member 171.

In addition, the seal member 171 contacts the radially inner periphery of the annular groove 61*a*, and partially contacts the radially outer periphery of the annular groove 61*a*. A clearance is formed by a portion of the annular groove 61*a* which is closer to the radially outer periphery than the seal member 171 and is not in contact with the seal member 171. The brake fluid can flow into the clearance. On the second cylinder 71*b*, a passage 61*b* extends from a portion of the annular groove 61*a*. The discharge port 61 is thus formed by the clearance of the annular groove 61*a* configured as described above and the passage 61*b*.

The discharge port 61 is also connected with a discharge passage 152 that is formed in the housing 150. This connection is achieved via an annular groove 162, which is formed on a part of the concave portion 150*a*, the part being in the vicinity of the leading end of the pump body 100 in the insertion direction and surrounding the entire circumferential surface of a portion of the pump body 100.

In addition, the second cylinder 71*b* includes a discharge port 63, which is located on an end surface of the second cylinder 71*b* opposite to the end surface at which the discharge port 61 is formed. In other words, the discharge port 63 is located on an end surface of the second cylinder 71*b* facing the rotary pump 13. The discharge port 63 is in communication with a gap portion at the discharge side of the rotary pump 13.

The discharge port 63 extends from the above mentioned opposite end surface of the second cylinder 71*b* to an outer periphery of the second cylinder 71*b*. The discharge port 63 has a structure substantially identical to the discharge port 61. The discharge port 63 includes a clearance of an annular groove 63*a* within which a ring-shaped seal member 172 having a resin member 172*a* and a rubber member 172*b* is located. The discharge port 63 also includes a passage 63*b* that extends from the highest position of the annular groove 63*a*. The discharge port 63 is also connected with a discharge passage 154. This connection is achieved via an annular groove 163, which is formed on a part of the concave portion 150*a*, the part surrounding the entire circumference of the center plate 73*b*. The annular groove 63*a* is formed solely by deformation processing such as forging.

The seal member 172 has the same configuration with the seal member 171. A space between the rotary pump 13 and the second cylinder 71*b* is sealed by the seal member 172. More specifically, relatively low-pressure region and a relatively high-pressure region on the inner and outer peripheries of the seal member 171 are separated from each other and sealed by the seal member 172.

The third cylinder 71*c*, which serves as an example of a second side cylinder, faces an end of the rotary pump 13. The third cylinder 71*c* and the rotary pump 13 are in contact with each other so that a space between the third cylinder 71*c* and the rotary pump 13 is sealed. The third cylinder 71*c* should be highly stiff and therefore is made of high-carbon steel, because the third cylinder 71*c* not only comes in friction with the rotary pump 13 but also is directly in touch with the disc spring 210.

The third cylinder 71*c* has an intake port 62 that is in communication with the gap portions on the intake side of the rotary pump 13.

The intake port 62 penetrates the third cylinder 71*c* starting from the end surface on the rotary pump 13 side of the third cylinder 71*c* to the end surface on the opposite side thereof. The intake port 62 runs from the end surface on the above mentioned opposite side to the outer peripheral surface of the third cylinder 71*c*.

More specifically, the intake port 62 is formed by the third center hole 72*c* of the third cylinder 71*c*. The diameter of the third center hole 72*c* is enlarged and a groove is hence formed at a portion on the third center hole 72*c*. As shown in FIGS. 3A and 3B, the third center hole 72*c* of the third cylinder 71*c* has an oval (or elongated) shape on the rotary pump 13 side (a deeper side in FIG. 3A). The drive shaft 54 is located closer to the semicircle at the top end portion of the oval shape than to the semicircle at the bottom end portion of the oval shape. A space serving as the discharge port 62 is formed between the drive shaft 54 and the semicircle at the bottom end portion of the oval shape. The oval shape of the bottom end portion may be replaced with a rectangular shape.

The third center hole 72*c* is enlarged at an intermediate position in the axial direction of the third cylinder 71*c* so as to have a diameter equal to that of the bearing 52. The bottom end portion of the oval shape is connected with a groove that extends to the outer peripheral surface of the third cylinder 71*c*. The connection is made at an end surface on the side of the third cylinder 71*c* opposite to the rotary pump 13 side thereof. This groove may have a cross-section with a rectangular shape or a semi-oval shape, although it has the cross section with the rectangular shape in the present embodiment.

The intake port 62 includes a crescent-shaped portion which is not occupied by the bearing 52. The intake port 62 also includes the groove which is formed on the end surface of the third cylinder 71*c* opposite to the rotary pump 13 side thereof. The groove extends to the outer peripheral surface of the third cylinder 71*c*. The brake fluid is therefore introduced from the outer peripheral surface of the third cylinder 71*c*, which serves as an inlet. The intake port 62 is connected with an intake passage 153 that is formed in the housing 150. This connection is achieved via an annular groove 164, which is formed on a part of the concave portion 150*a*, the part surrounding the entire circumference of a portion of the pump body 100, the portion including the inlet of the intake port 62.

The intake passage 153 and the discharge passage 154 shown in FIG. 2 correspond respectively to the conduit C2 and C1 in FIG. 1.

Since the third center hole 72*c* is used as a part of the intake port 62, the brake fluid is delivered to the drive shaft 54, the bearing 52 and the like. This in turn allows smooth rotation of the drive shaft 54. In addition, the intake port 62 is positioned closer to the motor 11 (or, closer to an exterior of the housing 150) than the discharge port 63 is. Therefore, the brake hydraulic pressure at a portion in the vicinity of the discharge port 63 is suppressed.

The second center hole 72*b* of the second cylinder 71*b* has a portion whose diameter is larger than that of the drive shaft 54. A seal member 80 is located in this enlarged-diameter portion. The seal member seals space between the second center hole 72*b* and the drive shaft 54 and separates the first rotary pump 10 from the second rotary pump 13. The seal member 80, which serves as an example of an axial seal member, includes a ring-shaped elastic member (hereinafter referred to as an O-ring 81) and a ring-shaped resin member 82. The resin member 82 includes a groove portion which is dug in the radial direction of the resin member 82. The O-ring 81 fits in the resin member (more specifically, in the groove portion.) The elastic force of the O-ring 81 presses the resin member 82 into contact with the drive shaft 54.

The resin member 82 and the second center hole 72*b* of the second cylinder 71*b* similarly have substantially D-shaped cross sections (not shown) in which an end of a round shape is cut off and an arc and a string are formed. The resin member 82 also fits in the second center hole 72*b* of the second cylinder 71*b*. Therefore, cut-off portions of the resin member 82 serves as a key to prohibit the seal member 80 from rotating relative to the second cylinder 71*b*.

The annular groove 63*a* formed on the second cylinder 71*b* is located radially outside of the seal member 80. In other words, the annular groove 63*a* and the seal member 80 overlap as seen in the radial direction of the drive shaft 54.

The fourth cylinder 71*d* is concave at a surface opposite to the surface on which the disc spring 210 is located. The drive shaft 54 projects from this concaved portion. The drive shaft 54 has a key-shaped connective portion 54*c* on an end surface of the projecting portion. The connective portion 54*c* is inserted into a drive shaft 11*a* of the motor 11. Accordingly, the single drive shaft 54 is rotated by the motor 11 via the drive shaft 11*a*, in turn the rotary pumps 10 and 13 are driven.

Additionally, a diameter of an inlet on the concaved portion of the fourth cylinder 71*d* is equal to that of a hole 11*c*, which is formed on a holder 11*b* of the motor 11. A clearance between the concaved portion of the fourth cylinder 71*d* and the hole 11*c* is minimized and a bearing 180 is located in them so as to axially support the drive shaft 11*a*. Although the drive shaft 11*a* is axially supported by the bearing 180, the drive shaft 54 may be axially supported in place of the drive shaft 11*a*.

As described above, the bearing 180 is located on the hole 11*c* of the holder 11*b* and the concaved portion of the fourth cylinder 71*d*. The motor 11 and the fourth cylinder 71*d* are therefore properly positioned and axial misalignment of the drive shaft 11*a* and the drive shaft 54 can be minimized.

A seal member 90 and an oil seal 91 are aligned in the axial direction of the drive shaft 54 and are inserted and fixed in the concaved portion of the fourth cylinder 71*d* in such a manner that the seal member 90 and the oil seal 91 cover an outer periphery of the drive shaft 54. The seal member 90 has a structure identical to the seal member 80 and seals the brake fluid which leaks from the intake port 62.

In addition, O-rings 74*a*, 74*b*, 74*c*, and 74*d* are disposed circumferentially on the outer peripheral surfaces of the first to fourth cylinders 71*a* to 71*d*, respectively. The O-rings 74*a* to 74*d* seal the brake fluid in the intake passages 151, 153 and the discharge passages 152, 154, which are formed in the housing 150. The O-rings 74*a* to 74*d* are respectively disposed between the intake passage 151 and the discharge passage 152, between the discharge passage 152 and the discharge passage 154, between the discharge passage 154 and the intake passage 153, and between the intake passage 153 and the housing 150. In FIG. 3A, a groove which the O-ring 74*c* fits in is not shown for convenience of illustration.

A diameter of the radially outer periphery of the fourth cylinder 71*d* is reduced at the inlet-side edge of the concaved portion of the fourth cylinder 71*d*. A stepped portion is therefore formed on the outer periphery of the fourth cylinder 71*d*. This reduced-diameter portion fits in the ring-shaped external thread member 200 described above so that the pump body 100 is fixed.

A description will be given of the operation of the brake device and the pump body 100.

The brake device drives the pump body 100 to draw in the brake fluid in the reservoir 40, increase the pressure of the brake fluid, and discharge the brake fluid in occasions including the first one when the vehicle wheel exhibits a lock tendency and ABS control accordingly operates, and the second one when a large braking force is required. The second occasion may occur, for example, when a braking force to match the brake pedaling force cannot be obtained, or when the brake pedal 1 has been operated a large amount. The discharged high pressure brake fluid increases the pressure of the wheel cylinders 4 and 5.

In these occasions, the pump body 100 performs basic pump operation where the rotary pumps 10 and 13 draw in the brake fluid through the intake passages 151 and 153, respectively, and discharge brake fluid through the discharge passages 152 and 154, respectively.

During the basic pump operation, the brake hydraulic pressures at discharge-side of the rotary pumps 10 and 13 become extremely large. Therefore, the brake fluid applies a force in a direction in which the pump body 100 gets out of the housing 150. However, as explained above, the axial force of the pump body 100 is secured by the disc spring 210 and the external thread member 200. Therefore, the pump body 100 is kept from wobbling in the housing 150.

In the present embodiment, a cylinder portion which forms the contour of the pump body 100 is constructed by more than one component. More specifically, the pump body 100 is divided, at a place between the rotary pump 10 and the motor 11, into two components, that is, the third cylinder 71*c* and the fourth cylinder 71*d*. In addition, the disc spring 210 is located between the third cylinder 71*c* and the fourth cylinder 71*d*.

In a conventional vehicular brake device, a cylinder portion which forms the contour of a pump body is composed of a single component between a rotary pump and a motor and has an intake port. Since a bearing and a seal must be disposed in the cylinder portion, the cylinder portion with the conventional structure inevitably has a considerable axial length. However, nothing is provided at regions which are closer to the outer periphery of the pump body than the bearing or seal is. The regions thus become dead space.

In contrast, the disc spring 210 is located between the third cylinder 71*c* and the fourth cylinder 71*d* in the present embodiment. Therefore, space can be effectively utilized. A total axial length (pump shaft length) of the pump body 100, including the third cylinder 71*c*, the fourth cylinder 71*d*, and the disc spring 210, can thus be shortened compared to a pump body in which the disc spring 210 is located at an end position of the pump body 100.

The disc spring 210 is configured such that a bottom surface thereof (a side on which a load acts on an outer peripheral portion) faces the rotary pumps 10 and 13 and a top surface side thereof (a side on which a load acts on an inner peripheral portion) faces the motor 11 side.

If the top surface of the disc spring 210 faced the rotary pumps 10 and 13 and the bottom surface of the disc spring 210 faced the motor 11 side, then the following problems might occur.

A reaction force or the like which is generated when the pump body 100 is pressed against the bottom surface of the concave portion 150*a* is transmitted to the disc spring 210, via the outer peripheral portion of the first cylinder 71*a*, the first center plate 73*a*, the outer peripheral portion of the second cylinder 71*b*, the second center plate 73*b*, and the outer peripheral portion of the third cylinder 71*c*. At that time, such a load must be borne by the top surface of the disc spring 210.

In this case, the load acts on the outer peripheral side of the third cylinder 71*c* while the load is actually borne at a position closer to the inner peripheral side of the third cylinder 71*c*. As a consequence, this displacement could deform the third cylinder 71*c*.

In the present embodiment, however, the load can be borne by the bottom surface of the disc spring 210, that is, the outer peripheral side of the third cylinder 71*c*. Therefore, the load can be reliably borne at the bottom surface of the disc spring 210, and deformation of the third cylinder 71*c* is suppressed.

As described above, the bearing 51 is located with the movement of the outer race 51*b* in the longitudinal direction of the drive shaft 54 being restricted, and the drive shaft is fixed to the inner race 51*c* with the press fit. Therefore, it is possible to prevent the drive shaft 54 from escaping from the first cylinder 71*a*. As a consequence, an additional member for preventing the drive shaft 54 from escaping is not necessary, which suppresses number of elements for composing the pump device 100 and makes it possible to shorten the drive shaft 54.

As described above, the inner race 51*c* is longer than the outer race 51*b*. Therefore, it is possible to obtain sufficient strength of the press fit of the drive shaft in the inner race 51*c* while suppressing the size of the outer race 51*b* (in other words, suppressing the size of the pump device 100). As a consequence, the size of the pump device 100 can be suppressed while increasing reliability of the function for preventing the drive shaft 54 from escaping.

As described above, the movement of the outer race 51*b* in the longitudinal direction of the drive shaft 54 is restricted because the outer race 51*b* is in touch with the edge of the stepped shape of the center hole 71 a and the bottom of the concave portion 150*a*. Therefore, the drive shaft 54 can be prevented from moving toward any side along its longitudinal direction. Therefore, it is not necessary to have a radially enlarged portion which a conventional pump device includes as described before. As a consequence, the drive shaft 54 can be made to have a simple shape.

The outer race 51*b* is inserted with the loose fit into the first cylinder 71*a*. Therefore, it is possible to avoid deformation of the first cylinder 71*a* which might occur in the case that the outer race 51*b* is inserted with a press fit into the first cylinder 71*a*. Similarly, the outer race 52*b* is inserted with the loose fit into the third cylinder 71*c*. Therefore, it is possible to avoid deformation of the third cylinder 71*c* which might occur in the case that the outer race 52*b* is inserted with a press fit into the third cylinder 71*c*.

The drive shaft 54 is also inserted with the loose fit into the inner race 52*c* of the bearing 52, which does not contribute to preventing the drive shaft 54 from escaping. Therefore, it is easy to attach the bearing 52 to the drive shaft 54.

In the bearing 52 which does not contribute to preventing the drive shaft 54 from escaping, the length in the longitudinal direction of the inner race 52*c* is as larger as that of the outer race 52*b*. The small length in the longitudinal direction of the inner race 52*c* makes it possible to suppress the size of the pump device 100 and to use a general-purpose bearing for the bearing 52. As a consequence, manufacturing cost of the pump body 100 can be suppressed.

The outer race 51*b* located on the first center hole 72*a* of the first cylinder 71*a* is restricted in the movement in the longitudinal direction of the drive shaft 54 and is accordingly prevented from escaping from the first cylinder 71*a* because the outer race 51*b* is in touch with the edge of the stepped shape of the center hole 71*a* and the bottom of the concave portion 150*a* of the housing 150. In this case, a range within which the drive shaft 54 moves can be shorter than in the case that the outer race 52*b* located on the third center hole 72*c* of the third cylinder 71*c* is in touch with the third cylinder 71*c* and the fourth cylinder 71*d* so that the outer race 52*b* is restricted in the movement in the longitudinal direction of the drive shaft 54 and is accordingly prevented from escaping from the first cylinder 71*a*.

The third cylinder 71*c* and the fourth cylinder 71*d* can move relative to each other, and the clearance between the third cylinder 71*c* and the fourth cylinder 71*d* varies significantly depending on several factors such as a spring constant of the disc spring 210. Therefore, it is difficult to suppress a range within which the outer race 52*b* moves in the longitudinal direction of the drive shaft 54.

In contrast, a relation between the depth of the recessed part of the first center hole 72*a* and the length of the outer race 51*b* in the longitudinal direction of the drive shaft 54 defines a range within which the outer race 51 located on the first center hole 72*a* of the first cylinder 71*a* can move in the longitudinal direction of the drive shaft 54. It is therefore easy to shorten the range within which the outer race 51 located on the first center hole 72*a* of the first cylinder 71*a*.

As described above, a ball bearing is used for each of the bearings 51 and 52. It is therefore possible to make the bearings 51 and 52 to be shorter in the longitudinal direction of the drive shaft 54 than in the case that a needle bearing is used for each of the bearings 51 and 52.

In this embodiment, the space between the rotary pump 10 and the second cylinder 71*b* is sealed by the seal member 171. In addition, the space between the rotary pump 13 and the second cylinder 71*b* is sealed by the seal member 172. Therefore, it is not necessary to slide the rotary pumps 10 and 13 on the second cylinder 71*b* with a friction. It is not therefore necessary to compose the second cylinder with material of high hardness such as high-carbon steel or to harden the surface of the second cylinder 71*b* facing the rotary pumps 10 and 13. Therefore, the second cylinder 72*b* can be made in a simple manner, and the manufacturing cost of the second cylinder can be reduced.

For example, the second cylinder 71*b* can be made of low-carbon steel. In this case, it is possible to form, solely by deformation processing such as forging, the annular grooves 61*a* and 63*a* into which the seal members 171 and 172 are inserted respectively, since the low carbon steel is less stiff than the high-carbon steel. When the annular grooves 61*a* and 63*a* are formed solely by deformation processing, it is possible to shut out residual chips and burrs, which are produced if they are formed by cutting work. In addition, when the annular grooves 61*a* and 63*a* are formed solely by deformation processing, manufacturing cost can be reduced compared to the case that they are formed by cutting work.

The annular grooves 61*a* and 63*a* can be formed by deformation processing and can be finished by cutting work afterward. In this case, amounts of portions of the second cylinder 71*b* to be cut become smaller than in the case that they are formed solely by cutting work. It is therefore possible to improve workability of the second cylinder 71*b*.

The first cylinder 71*a* and the rotary pump 10 are in touch with each other so that the space between the first cylinder 71*a* and the rotary pump 10 is sealed. Similarly, the third cylinder 71*c* and the rotary pump 13 are in touch with each other so that the space between the third cylinder 71*c* and the rotary pump 13 is sealed. Therefore, it is not necessary to form an annular groove on the first cylinder 71*a* or the third cylinder 71*c* to accommodate a seal member. Needlessness of forming the annular groove is especially profitable in the case that the first cylinder 71*a* and the third cylinder 71*c* are made of material of high hardness such as the high-carbon steel.

In this embodiment, the seal member 80 is located on the center hole 72*b* of the second cylinder 71*b*, and the annular groove 63*a* is located radially outside of the seal member 80. In this case, the length of the second cylinder in the longitudinal direction of the drive shaft 54 can be smaller than in the case that the seal member 80 and the annular groove 63*a* are aligned along the longitudinal direction of the drive shaft 54. Therefore, the size of the pump device 100 can be reduced.

Other Embodiments

In the above embodiment, ball bearings are used for the bearings 51 and 52 for supporting the drive shaft 54. However, radial bearings (e.g. a cylindrical roller bearings, tapered roller bearings) other then the ball bearings can be used for the bearings 51 and 52.

In the above embodiment, the movement of the outer race 51*b* in the longitudinal direction of the drive shaft 54 is restricted because the outer race 51*b* is in touch with the edge of the stepped shape of the first center hole 72*a* and the bottom of the concave portion 150*a* of the housing 150. However, the movement of the outer race 51*b* in the longitudinal direction of the drive shaft 54 can be restricted by inserting the outer race 51*b* into the first center hole 72*a* by a press fit.

In the above embodiment, the drive shaft 54 is inserted by the loose fit into the inner race 52*c* of the bearing 52. However, the drive shaft 54 can be inserted by a press fit into the inner race 52*c* of the bearing 52.

It is desirable, as described above, to insert the outer race 52*b* by the loose fit in order to suppress deformation of the third cylinder 71*c*. However, the present invention is not limited to the loose fit. For example, the outer race 52*b* can be fixed by a press fit to the third cylinder 71*c*. In this case, the outer race 52*b* is restricted in its movement in the longitudinal direction of the drive shaft 54.

In the above embodiment, the length of the inner race 52*c* in the longitudinal direction of the drive shaft 54 is as large as that of the outer race 52*b*. However, the length of the inner race 52*c* in the longitudinal direction of the drive shaft 54 may be larger than that of the outer race 52*b*.

In the above embodiment, the pump device 100 is applied to the vehicle brake device. However, the pump device of the present invention can be applied to devices other than the vehicle brake device.

In the above embodiment, the first cylinder 71*a* and the third cylinder 71*c* are made of high-carbon steel. However, they can be made of material of hardness other than high-carbon steel. Moreover, they can be made of material of softness such as low-carbon steel. In this case, the first cylinder 71*a* and the third cylinder 71*c* may be surface hardened at its portion on which the rotary pump 10 or the rotary pump 13 slides and at its portion which is in touch with the disc spring 210.

In the above embodiment, the first cylinder 71*a* and the rotary pump 10 are in touch with each other so that the space between the first cylinder 71*a* and the rotary pump 10 is sealed. In addition, the third cylinder 71*c* and the rotary pump 13 are in touch with each other so that the space between the third cylinder 71*c* and the rotary pump 13 is sealed. However, an annular groove which is similar to the annular grooves 61*a* and 63*a* may be formed on a surface of the first cylinder 71*a* facing the rotary pump 10 or on a surface of the third cylinder 71*c* facing the rotary pump 13. In this case, a seal member similar to the seal members 171 and 172 may be located within each of the grooves on the first cylinder 71*a* and the third cylinder 71*c*, so that the grooves seal the space between the first cylinder 71*a* and the rotary pump 10 and the space between the third cylinder 71*c* and the rotary pump 13.

In this case, the first cylinder 71*a* can be made of material of softness such as low-carbon steel and made without surface hardening. The third cylinder 71*c* can also be made of material of softness such as low-carbon steel and made without surface hardening, if a spring seating member made of material of hardness is inserted between the disc spring 210 and the third cylinder 71*c*.

In the above embodiment, the annular groove 63*a* is located radially outside of the seal member 80. However, it is possible that the annular groove 63*a* is not located radially outside of the seal member 80. In this case, the seal member 80 and the annular groove 63*a* may be aligned along the longitudinal direction of the drive shaft 54.

The seal member 80 may be moved or elongated toward the rotary pump 10 compared to the example shown in FIG. 2, so that the annular groove 61*a* is located radially outside of the seal member 80. It is also possible that the annular groove 61*a* is not located radially outside of the seal member 80. In this case, the seal member 80 and the annular groove 61*a* may be aligned along the longitudinal direction of the drive shaft 54.

In the above embodiment, the annular grooves 61*a* and 63*a* are formed solely by deformation processing such as forging. However, the annular grooves 61*a* and 63*a* can be formed by deformation processing and finished cutting work afterward.

In the above embodiment, the internal gear pump is used for each of the rotary pumps 10 and 13. However, other rotary pumps such as a vane pump can be used for each of the rotary pumps 10 and 13.

What is claimed is:

1. A pump device comprising:

a case;

a drive shaft inserted in the case;

a plurality of bearings for supporting the drive shaft and allowing the drive shaft to rotate; and a pump located in the case, the pump being driven by the drive shaft to draw in and discharge fluid;

wherein:

at least a first one of the plurality of bearings includes:

an inner race into which the drive shaft is press fitted;

an outer race located in the case so that movement of the outer race in the longitudinal direction of the drive shaft restricted, and a length of the inner race in the longitudinal direction of the drive shaft is greater than a length of the outer race in the longitudinal direction of the drive shaft; and a rolling body is inserted between the inner race and the outer race, and the rolling body restricts relative movement between the inner race and the outer race in the longitudinal direction of the drive shaft;

the outer race is fitted into the case with a loose fit, and movement of the outer race is restricted in the longitudinal direction of the drive shaft by a movement-restricting surface of the case, and the movement-restricting surface faces the longitudinal direction of the drive shaft and is in contact with the outer race; and at least a second one of the plurality of bearings includes an inner race into which the drive shaft is inserted with a loose fit.

2. The pump device according claim 1, wherein the case is a first case, and the pump device comprises:

a housing including a concave portion;

a second case located coaxially with the first case, wherein the second case is movable relative to the first case in the longitudinal direction of the drive shaft; and a spring member located between the first case and the second case, wherein:

the spring member biases the first case and second case so that the first case and second case are urged apart from each other, the first case and the second case are inserted into the concave portion in a manner so that the first case is closer to the bottom of the concave portion than the second case;

the second case is pressed away from the first case in a direction from the entrance of the concave portion to the first case;

the movement-restricting surface is a first surface of the first case; and the outer race is in contact with a second surface of the first case, and the second surface faces a bottom surface of the concave portion, and the outer race is in contact with the bottom surface of the concave portion, so that movement of the outer race is restricted in the longitudinal direction of the drive shaft.

3. The pump device according to claim 2, wherein, the pump is a gear pump and at least one of the plurality of bearings is a ball bearing.

4. The pump device according to claim 3, wherein the bump is a first pump, and the pump device further comprises:

a second pump installed in the case, wherein:

the second pump is driven by the drive shaft to draw in and discharge fluid, and the second pump is aligned with the first pump in the longitudinal direction of the drive shaft, the first case includes:

a middle cylinder located between the first pump and the second pump, wherein the middle cylinder is faced by a surface of the first pump and a surface of the second pump;

a first side cylinder located at the opposite side of the first pump from the middle cylinder, the first side cylinder being faced by the other surface of the first pump; and a second side cylinder located at an opposite side of the second pump from the middle cylinder, the second side cylinder being faced by the other surface of the second pump;

annular grooves are formed respectively on surfaces of the middle cylinder, the surfaces facing respectively the first pump and the second pump;

a first seal member sealing a space between the first pump and the middle cylinder, and the first seal member is located within one of the annular grooves;

a second seal member seals a space between the second pump and the middle cylinder, and the second seal member is located within another one of the annular grooves;

the middle cylinder includes a center hole into which the drive shaft is inserted;

an axis seal member is located at the center hole and seals a space between the middle cylinder and the drive shaft; and one of the annular grooves is located radially outside of the axis seal member.

5. A pump device comprising:

a case;

a drive shaft fitted in the case;

a plurality of bearings for supporting the drive shaft and allowing the drive shaft to rotate; and a pump located in the case, wherein the pump is driven by the drive shaft to draw in and discharge fluid;

wherein:

at least a first one of the plurality of bearings includes:

an inner race into which the drive shaft is press fitted;

an outer race located in the case so that movement of the outer race in the longitudinal direction of the drive shaft is restricted, wherein a length of the inner race in the longitudinal direction of the drive shaft is greater than a length of the outer race in the longitudinal direction of the drive shaft; and a first rolling body is inserted between the inner race and the outer race to restrict relative movement between the inner race and the outer race in the longitudinal direction of the drive shaft; and at least a second one of the plurality of bearings includes an inner race into which the drive shaft is inserted with a loose fit.

6. The pump device according to claim 5, wherein the pump is a first pump, and the pump device further comprises a second pump installed in the first case, wherein:

the second pump is driven by the drive shaft to draw in and discharge fluid, and the second pump is aligned with the first pump in the longitudinal direction of the drive shaft, the case includes:

a middle cylinder located between the first pump and the second pump, wherein the middle cylinder is faced by a surface of the first pump and a surface of the second pump;

a first side cylinder located at an opposite side of the first pump from the middle cylinder, the first side cylinder being faced by the other surface of the first pump; and a second side cylinder located at the opposite side of the second pump from the middle cylinder, the second side cylinder being faced by the other surface of the second pump;

annular grooves are formed respectively on surfaces of the middle cylinder, the surfaces facing respectively the first pump and the second pump;

a first seal member seals a space between the first pump and the middle cylinder, and the first seal member is located within one of the annular grooves; and a second seal member seals a space between the second pump and the middle cylinder, and the second seal member is located within another one of the annular grooves;

the middle cylinder includes a center hole into which the drive shaft is inserted;

an axis seal member is located at the center hole and seals a space between the middle cylinder and the drive shaft; and one of the annular grooves is located radially outside of the axis seal member.

* * * * *